US009808906B2

(12) United States Patent
Chang et al.

(10) Patent No.: US 9,808,906 B2
(45) Date of Patent: Nov. 7, 2017

(54) POLISHING SYSTEM WITH FRONT SIDE PRESSURE CONTROL

(71) Applicant: Applied Materials, Inc., Santa Clara, CA (US)

(72) Inventors: Shou-Sung Chang, Mountain View, CA (US); Takashi Fujikawa, San Jose, CA (US); Hung Chih Chen, Sunnyvale, CA (US); Paul D. Butterfield, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 15/173,491

(22) Filed: Jun. 3, 2016

(65) Prior Publication Data

US 2016/0279756 A1 Sep. 29, 2016

Related U.S. Application Data

(63) Continuation of application No. 14/213,842, filed on Mar. 14, 2014, now Pat. No. 9,358,658.

(60) Provisional application No. 61/801,163, filed on Mar. 15, 2013.

(51) Int. Cl.

| | |
|---|---|
| ***B24B 37/005*** | (2012.01) |
| ***B24B 37/04*** | (2012.01) |
| ***B24B 37/10*** | (2012.01) |
| ***B24B 49/16*** | (2006.01) |
| ***B24B 37/32*** | (2012.01) |
| ***B24B 37/16*** | (2012.01) |

(52) U.S. Cl.

CPC ..... *B24B 37/005* (2013.01); *B24B 37/042* (2013.01); *B24B 37/10* (2013.01); *B24B 37/16* (2013.01); *B24B 37/32* (2013.01); *B24B 49/16* (2013.01)

(58) Field of Classification Search

CPC ..... B24B 49/16; B24B 37/005; B24B 37/04; B24B 37/042; B24B 37/10; B24B 37/12; B24B 37/20; B24B 37/30

USPC ... 451/10, 11, 12, 41, 59, 63, 285, 287, 288, 451/289, 290

See application file for complete search history.

(56) References Cited

U.S. PATENT DOCUMENTS

| | | | |
|---|---|---|---|
| 5,558,568 | A | 9/1996 | Talie et al. |
| 5,575,707 | A | 11/1996 | Talieh et al. |
| 5,800,248 | A | 9/1998 | Pant et al. |
| 6,062,959 | A | 5/2000 | Weldon et al. |
| 6,241,585 | B1 | 6/2001 | White |
| 6,379,216 | B1 | 4/2002 | Raeder |

(Continued)

FOREIGN PATENT DOCUMENTS

| | | |
|---|---|---|
| KR | 10/2002/0079220 | 10/2002 |
| KR | 10/2005/0108743 | 11/2005 |

(Continued)

OTHER PUBLICATIONS

International Search Report and Written Opinion in International Application No. PCT/US2014/029450, mailed Jul. 24, 2014, 17 pages.

*Primary Examiner* — Eileen Morgan
(74) *Attorney, Agent, or Firm* — Fish & Richardson P.C.

(57) ABSTRACT

A polishing apparatus includes a platen having a first surface to support a polishing pad and a second surface, a carrier head to hold a substrate against the polishing pad, a plurality of through-holes defined in the platen, and a pad pressure control assembly adjacent on a side of the platen opposite the carrier head.

9 Claims, 8 Drawing Sheets

(56) References Cited

U.S. PATENT DOCUMENTS

| | | | |
|---|---|---|---|
| 6,435,948 | B1 | 8/2002 | Molnar |
| 6,719,615 | B1 | 4/2004 | Molnar |
| 6,769,970 | B1 | 8/2004 | Taylor et al. |
| 6,857,947 | B2 | 2/2005 | Wang et al. |
| 6,875,085 | B2 | 4/2005 | Weldon et al. |
| 6,899,607 | B2 | 5/2005 | Brown |
| 6,913,518 | B2 | 7/2005 | Chen et al. |
| 6,942,546 | B2 | 9/2005 | Desai et al. |
| 7,059,937 | B2 | 6/2006 | Brown |
| 7,121,933 | B2 | 10/2006 | Kim |
| 7,153,182 | B1 | 12/2006 | Taylor et al. |
| 7,276,743 | B2 | 10/2007 | Manens et al. |
| 2003/0153245 | A1 | 8/2003 | Talieh et al. |
| 2004/0023606 | A1 | 2/2004 | Wang et al. |
| 2006/0160474 | A1 | 7/2006 | Tseng et al. |
| 2010/0099340 | A1 | 4/2010 | Chen |
| 2012/0171933 | A1 | 7/2012 | Chen |
| 2014/0273765 | A1 | 9/2014 | Chang et al. |
| 2014/0273766 | A1 | 9/2014 | Chang et al. |

FOREIGN PATENT DOCUMENTS

| | | |
|---|---|---|
| KR | 10/2011/0016706 | 2/2011 |
| WO | WO 2012/082115 | 6/2012 |

POLISHING SYSTEM WITH FRONT SIDE PRESSURE CONTROL

CROSS-REFERENCE TO RELATED APPLICATIONS

This application is a continuation of U.S. application Ser. No. 14/213,842, filed on Mar. 14, 2014, which claims priority to U.S. application Ser. No. 61/801,163, filed on Mar. 15, 2013, both of which are incorporated by reference in their entirety.

TECHNICAL FIELD

This disclosure relates to the architecture of a chemical mechanical polishing (CMP) system.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

Some carrier heads include multiple independently pressurizable chambers so that pressure on different regions of the back surface of the substrate, i.e., the surface that is not being polished, can be controlled.

SUMMARY

In one aspect, a polishing apparatus includes a platen having a first surface to support a polishing pad and a second surface, a carrier head to hold a substrate against the polishing pad, a plurality of through-holes defined in the platen, and a pad pressure control assembly adjacent on a side of the platen opposite the carrier head.

Implementations may include one or more of the following features.

The pad pressure control assembly may include a plurality of independently controllable pad pressure control elements. The apparatus may include a plurality of fluid channels, each channel configured to direct a fluid from an output end of the channel to one or more of the plurality of through-holes. A pressure control assembly may be configured to direct the fluid through the fluid channels at sufficient pressure to press on the polishing pad supported on the first surface and deform a portion of the polishing pad that is positioned above the through-hole.

A bearing ring may surround one or more of the plurality of pad pressure elements. The bearing ring may be a contact bearing ring to contact a bottom surface of the platen. The bearing ring may be a fluid bearing ring to maintain a gap from a bottom surface of the platen. The bearing ring may be configured to adjust the distance between the pad pressure control elements and the second surface of the platen.

A linear rail may support the plurality of pad pressure elements. The plurality of pad pressure elements may be movable on the linear rail in a first direction in a plane parallel to the first surface of the platen, the plane being the first distance away from the platen. A second linear rail may support the plurality of pad pressure elements, and the plurality of pad pressure elements may be movable along the second rail in a plane parallel to the first surface of the platen in a second direction perpendicular to the first direction.

The plurality of pad pressure control elements may be magnets, each magnet being positioned in one of the plurality of through holes. A plurality of electromagnets and a controller may be configured to control a current applied to the electromagnets to exert a controllable amount of force on a corresponding magnets positioned in the through-holes. A magnet may be attached to the carrier head and configured to exert a force on the magnets positioned in the through-holes.

The pressure control assembly may include a plurality of independently controllable annular control zones. The plurality of independently controllable annular control zones may include a plurality of concentric elements each having a different radius, the plurality of concentric elements being positioned in a plane parallel to the platen, the plane being a first distance away from the second surface of the platen, the plurality of elements being closer to the second surface than the first surface. The plurality of independently controllable annular control zones may be segmented. The plurality of independently controllable annular control zones may be continuous.

In another aspect, a method of polishing includes supporting a polishing pad on a platen, holding a substrate in a carrier head with a surface of the substrate against a top surface of the polishing pad, applying a pressure on a bottom surface of the polishing pad from a plurality of through-holes defined in the platen, and controlling the pressure with a pad pressure control assembly adjacent the platen on a side of the platen opposite the carrier head.

In another aspect, a polishing apparatus includes a carrier head to hold a substrate against a polishing pad having a polishing surface in contact with the substrate, and a plurality of pad pressure control elements. The carrier head includes a retaining ring, and the control elements are arranged in a plane below a polishing surface of the polishing pad and configured to be activated by proximity of the retaining ring.

Implementations may include one or more of the following features.

The retaining ring may include a magnetic material. The magnetic material in the retaining ring may be configured to activate selected control elements when the magnetic material is vertically above the selected control elements.

The control elements may be magnets. The magnets may be positioned in a layer of flexible material. The magnets may be positioned in a plurality of through-holes in the platen.

The control elements may be actuators supported by the platen. The actuators may be connected to respective power sources and configured to be driven by a controller to drive the actuators in a vertical direction.

The control element may be arranged in a regular pattern. The pattern may cover spans an upper surface of the platen. The control elements may provide an active matrix layer.

In another aspect, a method of polishing includes supporting a polishing pad on a platen, holding a substrate in a carrier head with a surface of the substrate against a top surface of the polishing pad, retaining the substrate below the carrier head with a retaining ring, and applying a pressure on a bottom surface of the polishing pad with a plurality of pad pressure control elements, wherein the control elements are configured to be activated by proximity of the retaining ring.

Implementations can include one or more of the following potential advantages. Pressure on the substrate can be controlled from the outer surface of the substrate. The control pressure can be transferred efficiently to change the interface pressure of the polishing pad in the area of retaining ring and substrate edge. A post removal profile of the substrate can be more accurately controlled.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

Figure 1:
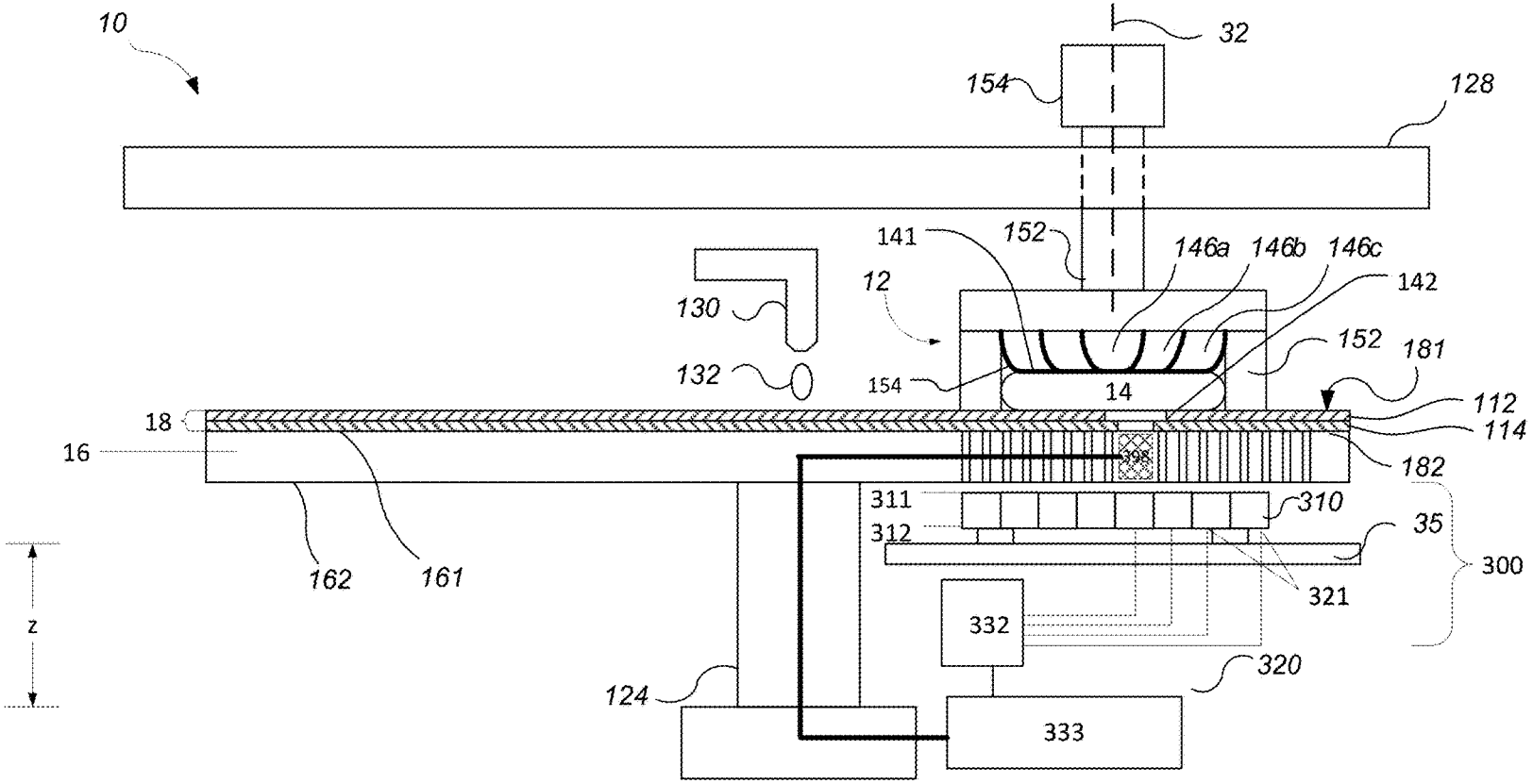
FIG. 1 shows a cross-sectional side view of selected elements of a CMP apparatus.

FIG. 1 shows a cross-sectional side view of selected elements of the CMP apparatus 10. The polishing apparatus 10 includes a platen 16 to support a polishing pad 18, and a carrier head 12 to hold a substrate 14 against a polishing surface 181 of the polishing pad 18.

The carrier head 12 can include a retaining ring 152 to retain the substrate 14 below a support structure 154, such as a flexible membrane. The substrate 14 has an inner surface 141 abutting the support structure. The carrier head 12 can control the polishing parameters, for example pressure, used to polish the substrate 10. For example, the carrier head 12 can includes a plurality of independently controllable pressurizable concentric chambers defined by the membrane, e.g., three concentric chambers 146*a*-146*c*, which can apply independently controllable pressurizes to associated zones on the flexible membrane 154 and thus on the substrate 14. Although only three chambers are illustrated in FIG. 1 for ease of illustration, there could be one or two chambers, or four or more chambers, e.g., five chambers. In addition, although only one carrier head is illustrated, there can be more than one carrier head.

In operation, the carrier head 12 holds a substrate 14 to be polished against the polishing surface 181 of the polishing pad 18 so that an outer surface 142 of the substrate 14 is in contact with the polishing surface 181. The inner surface 141 is in contact with the membrane 154.

The platen 16 has a top surface 161 and a bottom surface 162. The top surface 161 supports the polishing pad 18. A bottom surface 182 of the polishing pad 18 is in contact with the top surface 161 of the platen. The polishing pad 18 can be a two-layer polishing pad with a polishing layer 112 and a backing layer 114. The polishing pad 18 can be secured by an adhesive layer 28 to the platen. The adhesive layer 28 can be a double-sided adhesive tape, e.g., a thin layer of polyethylene terephthalate (PET), e.g., Mylar™, with adhesive, e.g., pressure-sensitive adhesive, on both sides.

The pressure with which a portion of the substrate 14 is pressed against the polishing surface 181 of the polishing pad 18 on the rotating platen 16 determines the polishing rate experienced by that portion of the substrate. This pressure is also an interface pressure between the surface 142 and the polishing surface 181. The profile of the substrate after polishing can also be referred to as the post removal profile. By applying different pressures to different portions of the substrate, the a substrate can be polished to achieve a desired post removal profile. For example when polishing an incoming substrate having uneven surface features (e.g., different surface heights across the substrate), the interface pressure profile across the substrate can be controlled to remove different amount of material across the surface of the substrate so that the post removal profile of the substrate results in a flat surface. Due to the rotation of the carrier head about the axis 32, the profile of the polished substrates will tend to be substantially rotationally symmetric.

Figure 2A:
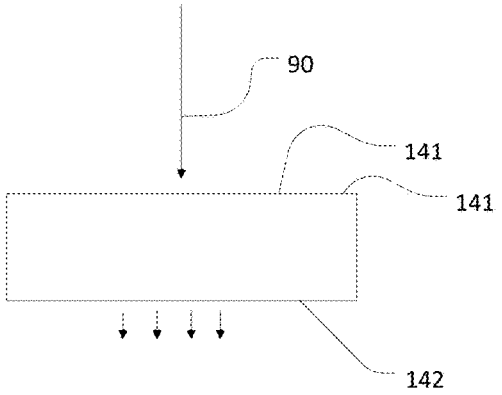
FIG. 2A schematically illustrates pressure distribution in a stiff substrate.
Figure 2B:
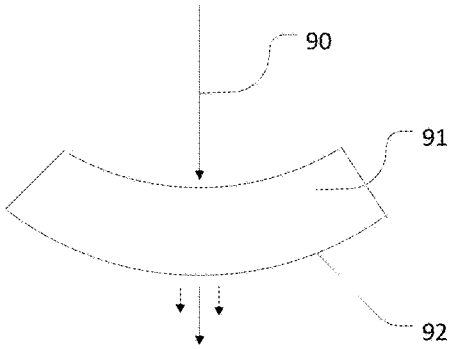
FIG. 2B schematically shows pressure distribution in a soft substrate.

When pressure is applied on the substrate 14 from the inner surface 141, the pressure is transmitted through a relatively stiff substrate 14 (e.g., a silicon wafer) to press the outer surface 142 of the substrate against the polishing surface 181. As shown in FIGS. 2A and 2B, a stiff substrate 14 will "redistribute" a localized pressure 90 across a portion of the lower outer surface 142 below and around the application point of the localized pressure 90. In contrast, layer 91 of a soft material performs less "redistribution" of the applied pressure, and transmits the pressure to a smaller localized region on an opposite surface 92.

Adjacent concentric chamber zones 146*a*-146*c* in the polishing head are contiguous without significant gaps or overlaps between the zones. However, as a result of the redistribution of pressure by the substrate 14, when different pressures are applied in adjacent regions from the inner surface of the substrate, there is a gradual transition between the regions in the applied pressure on the outer surface.

Figure 3A:
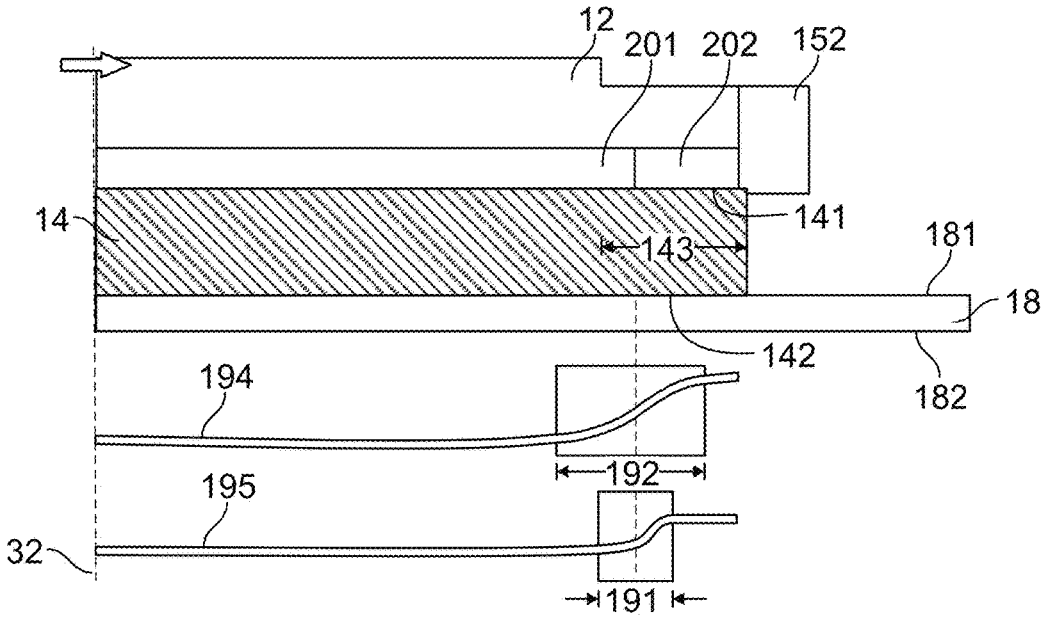
FIG. 3A schematically shows pressure distribution on a substrate outer surface in a carrier head.

A nominal transition width 192 is obtained when different pressures are applied to adjacent regions of the inner surface 141 of the substrate 14 (see FIG. 3A). A nominal interface pressure profile 194 may have a wider transition width than desired. It may be desirable to obtain a narrower transition width at the interface between two independently controllable regions. For example, it may be desirable to have narrower transition between an edge region 143 and a central region.

In some implementations, the edge region 143 may include the outermost 20 mm from the outer perimeter of the substrate. For a carrier head 12 having two concentric pressure chambers, a large central chamber 201 and a smaller rim chamber 202, the interface pressure profile experienced by the substrate will include a uniform (i.e. flat) portion in the center of the substrate and a transition region around the substrate edge (e.g., 20 mm from the outer perimeter of the substrate). Non-uniform interface pressure profile features tend to occur in a sub-region of the substrate edge (e.g., 10 mm from the edge), and due to the need for the pressure to be transmitted through the rigid substrate, fine interface pressure profile control of the zone transition at the substrate edge is difficult. The total width of the zone transition on both sides of the substrate when pressure is transmitted from the inner surface 141 to the outer surface 142 is 20 to 30 mm.

Instead or in addition to applying pressure on the substrate 14 from the inner surface 141, pressure can be applied directly to the outer surface 142 of the substrate 14. In particular, pressure is applied through the polishing pad 18.

A potential advantage of this configuration is that it can achieve a narrower transition width. Narrower transition widths can be obtained when the interface pressure is applied directly at specific locations on the outer surface 141 without having to have the pressure be transmitted through the rigid substrate 14.

The polishing system 10 includes a pressure control assembly that can control pressure applied upwards to the underside of the polishing pad 18. In some implementations, the pressure control assembly includes a plurality of control elements that are operable to apply a pressure to the underside of the polishing pad 18. The pressure is applied perpendicular to the top surface 161 of the platen or the outer surface 142 of the substrate 14 when held by the carrier head 12. The control elements can be uniformly spaced below the polishing pad. The control elements can cover at least any lateral area that the substrate can overlie during the polishing operation, e.g., substantially all of the polishing pad.

In some implementations, the control elements are movable in response to an applied magnetic force, e.g., from a magnet. For example, the control elements can be movable vertically, i.e., perpendicular to the top surface 161 of the platen or the outer surface 142 of the substrate 14 when held by the carrier head 12, in order to press against the underside of the polishing pad 18. In some implementations the control elements are movable vertically but are laterally restrained. In some implementations, the vertical motion of the control elements is independently controllable.

Figure 3B:
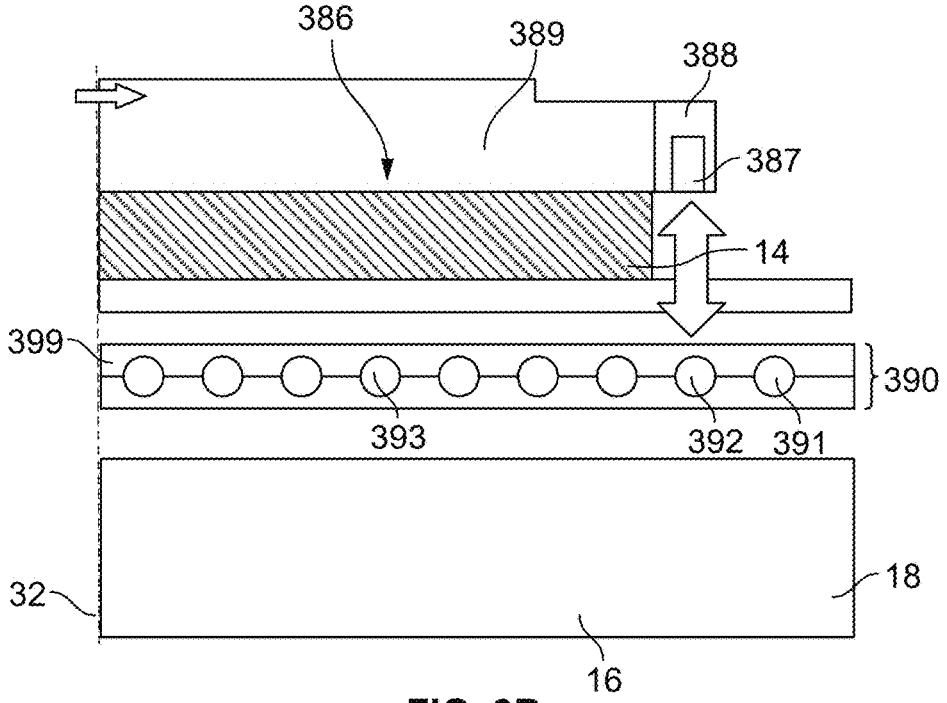
FIG. 3B-3C show embodiments that include an active matrix layer.
Figure 3C:
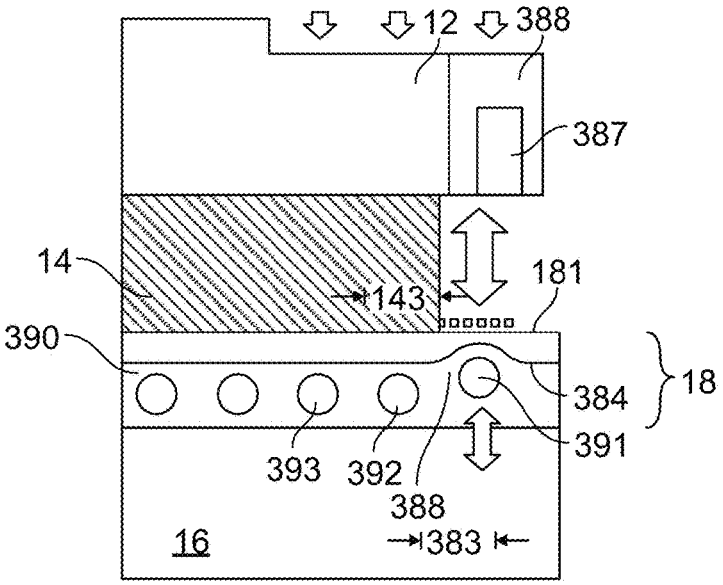

FIGS. 3B-3C show an active matrix layer (AML) 390 (FIG. 3B is a partially exploded view). The AML 390 can provide a narrower transition width for finer post removal profile control. The AML 390 can be supplied in an independent sub-pad 399 or it can be incorporated into the polishing pad 18. The AML 390 includes control elements (e.g., 391, 392, 393) that are embedded and laterally distributed within the AML 390 to form a layer of flexible motion elements. The control elements can be uniformly spaced through the AML 390. The AML 390 could be fabricated within an upper portion of the platen 16 or it could be adhered to the upper surface 181 of the platen.

A retaining ring 388 in the carrier head 12 can have a magnet 387, e.g., a permanent magnet or electromagnet 387, to interact with control elements 391-393 embedded in the AML 390. Each control element 391-393 can be a permanent magnet or a ferromagnetic material that can response to the magnetic field produced by magnet 387 carried by the modified retaining ring 388. The control element 391-393 can range in size from the micrometer scale to about 10 mm. The control element 391-393 can also be coils. The Lorentz force produced by the magnet 387 in the modified retaining ring manipulates an electric current in the coil. In some embodiments, it is possible to incorporate control elements in a region 386 of the modified carrier head to control the post removal profile in the central portions of the substrate.

During operation, the platen 16 and carrier head 12 rotate about their respective axis. As shown in FIG. 3C, the control element 391 below the modified retaining ring 388 is magnetically excited and translates vertically. The control element 391 will move towards or away from the magnet 387 in the retaining ring 388 depending on the relative orientation of the poles of the magnet 387 and the control element 391, i.e., toward if opposite poles are adjacent and away if similar poles are adjacent.

The movement of the control element 391 within the AML 390 changes the interface pressure of the polishing pad in the area of directly underneath the retaining ring 388 and also in the surrounding regions 384 and 385. The surrounding region 385 overlaps with a portion 384 of the polishing surface 181 that is in contact with an edge portion 143 of the substrate, and the interface pressure at that edge portion can either increase or decrease, allowing finer control of the post removal profile of the substrate.

The interface pressure can be increased when the control element translates upwards, compressing the polishing pad and pushing the polishing surface 181 closer to the substrate. Conversely, when the control element translates downwards, the polishing pad is stretched and the polishing surface 181 is pulled away from the substrate 14, lowering the interface pressure at the edge region of the substrate. The control element can translate downwards when a polarity of the electromagnet 387 in the modified retaining ring is reversed. A lower interface pressure at a particular location decreases the removal rate of the substrate in that region. The interface pressure of a lateral extent 383 of the region of polishing pad 18 can be controlled by the magnitude of the vertical displacement of the control element. A larger displacement would result in a larger region over which a transition zone of the substrate can be controlled. The activated control elements are deactivated when the retaining ring moves laterally away from the control element.

In some embodiments, the control elements can be actuators, e.g., piezoelectric actuators. When activated, the actuators extend or contract along a vertical axis, i.e., perpendicular to the top surface 161 of the platen or the outer surface 142 of the substrate 14 when held by the carrier head 12. The actuators can be uniformly spaced across a two-dimensional area below the polishing pad. Alternatively, the actuators can be arranged along a radial dimension 164 of the platen.

Figure 3D:
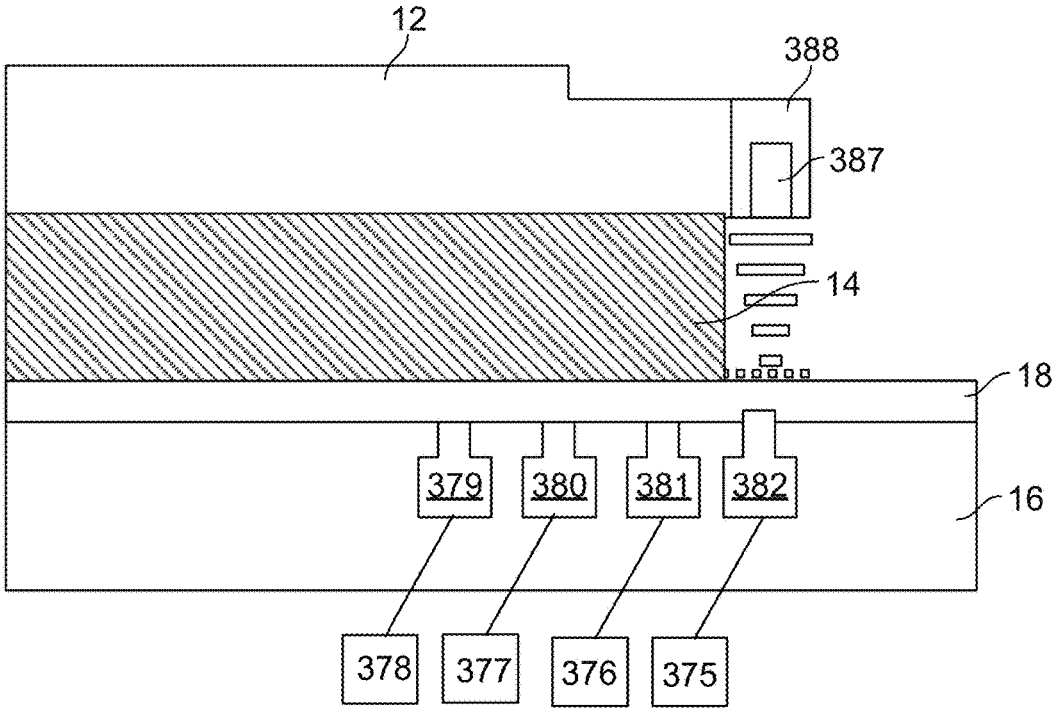
FIG. 3D shows an embodiment that include actuators.

As shown in FIG. 3D, instead of an AML 390, an upper portion of the platen 16 can include a number actuators 379-382. Although FIG. 3D shows only four actuators, there could be more actuators and the actuators could be uniformly spaced across the entire polishing pad.

The modified retaining ring 388 activates the actuators that positioned under retaining ring or another designated area. When actuators activate, another power source (375-378) will be used to drive the actuators (up or down) to create higher/lower interface pressure between the polishing surface 181 and the outer face 142 of the substrate 14.

The linear response of the control elements 391-393 and the actuators 379-382 ensures that the interface pressure can be effectively control because an area of interest where higher/lower interface pressure is required is not stationary but is dynamically changing. Linear response helps to ensure that no parasitic nonlinear responses persist in the control element or the actuators remains when the modified retainer rings exits a particular region, and also ensures that the elements and actuators can be activated quickly when the modified retainer ring enters a particular region.

In some embodiments, the control elements can be fluid pressure sources. When activated, each pressure sources pressurize or depressurize fluid in a respective volume below the polishing pad.

Figure 4G:
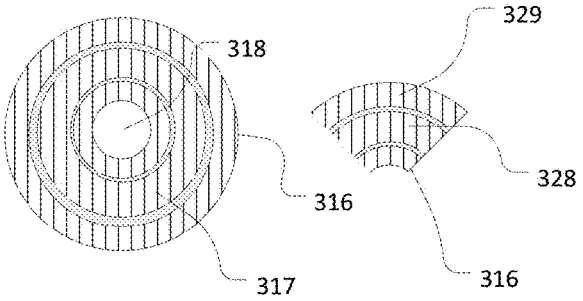
FIGS. 4A-4I show embodiments using a pneumatic pressure control system.
Figure 4H:
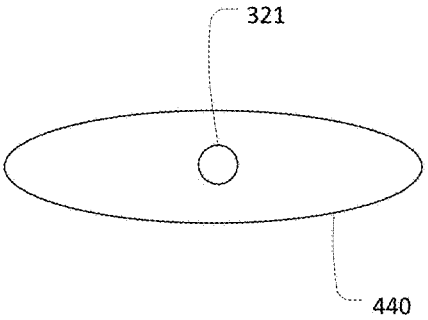
Figure 4I:
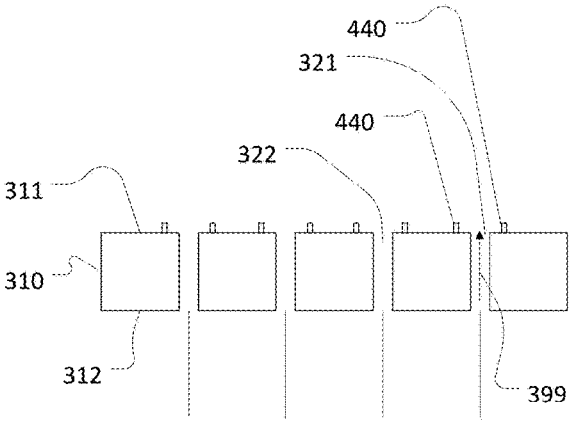
Figure 4A:
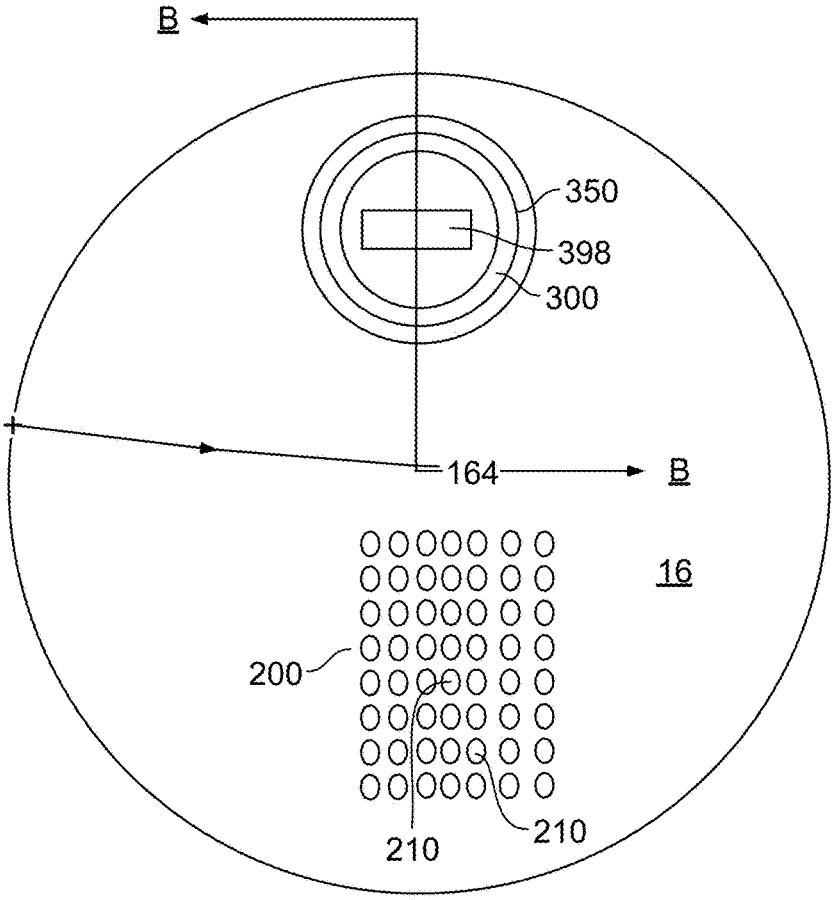

Thus, instead of or in addition to the AML 390, the interface pressure at the outer face 142 of the substrate 14 can be controlled by a pneumatic pressure control assembly 300 shown in FIG. 4A-4G. A pattern 200 of through-holes 210 is defined within the platen 16 (shown in FIG. 4A). The platen 16 has a radial dimension 164. FIG. 4A shows a top view of selected components of the CMP apparatus 10. The polishing pad 18 is not illustrated in FIG. 4A in order to show features of the platen 16.

Figure 4B:
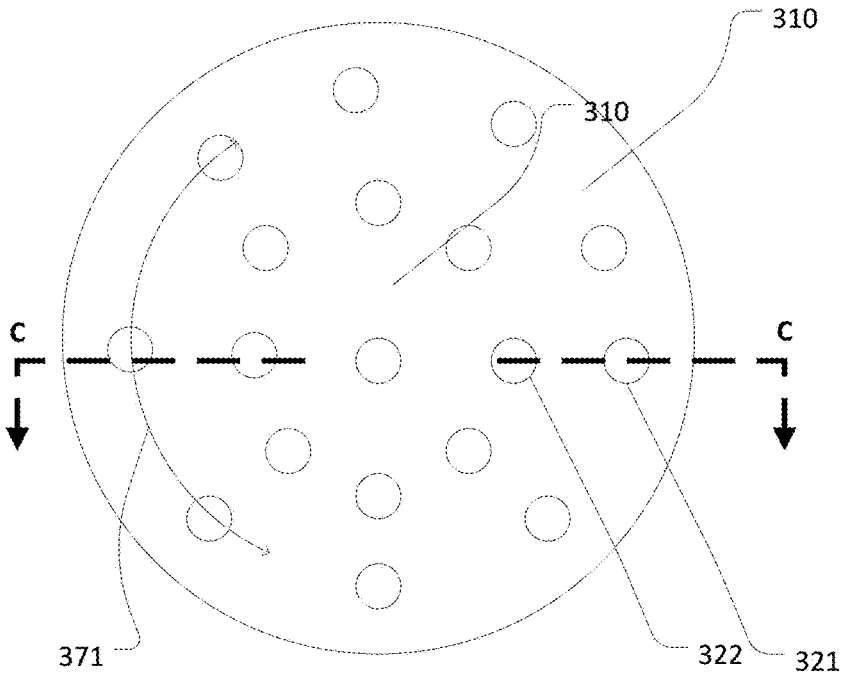
Figure 4C:
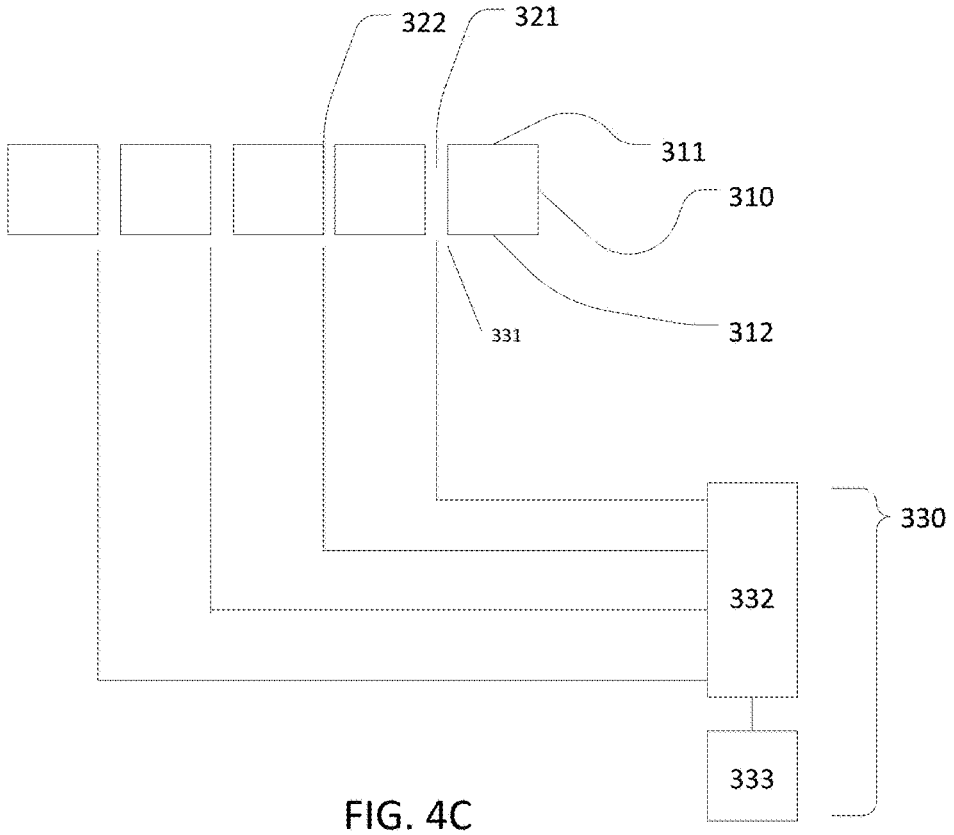
Figure 4D:
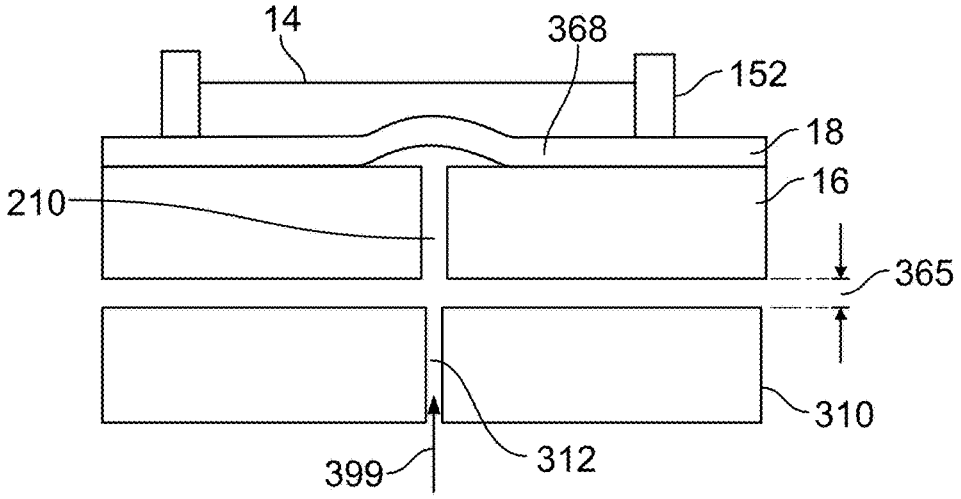
Figure 4E:
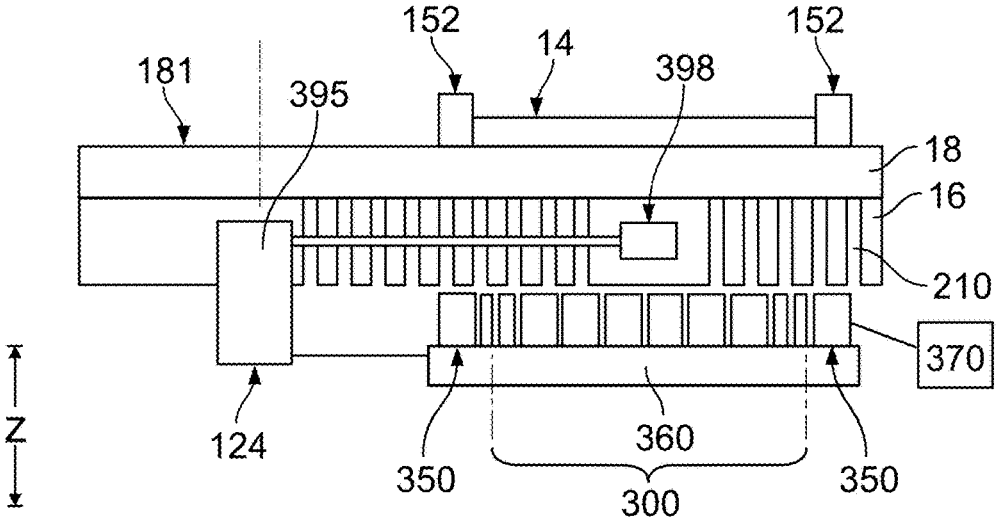

FIG. 4B shows a top view of the pneumatic pressure control assembly 300 includes a body 310, e.g., a disc, having a top surface 311 and a bottom surface 312. FIG. 4C shows a cross sectional view of the pneumatic pressure control assembly 300. Channels (e.g., 321 and 322) which are perpendicular to and extend through the top and bottom surface 311 and 312 are defined in the body. A fluid outlet 331 of a fluid delivery system 330 having a fluid source 332 is directed at the channel 321 from the bottom surface 312. A controller 333 is able to control the amount of fluid entering each individual channel defined in the body 310. The fluid in the channel then travels up a corresponding through-hole 210 in the platen 16. The corresponding through hole is one that is substantially vertically aligned with a specific channel in the body. The flow of fluid up the through hole from the lower surface 162 of the platen to the upper surface 162 exerts a force on the surface 182 of the polishing pad 18. This force deflects the surface 182 and in the process, exerts an interface pressure between the polishing surface 181 and the outer surface 142 of the substrate 14.

In some implementations, during polishing, the carrier head 12 translates along a lateral dimension 164, e.g., along the radius of the platen 120. For example, the carrier head 12 can move along a track 128 or be carried by a carousel, while the platen 16 rotates. The lateral translation of carrier head 12 allows the substrate 14 to more evenly and fully utilize available surface for polishing on the pad 18.

The body 310 in the pneumatic pressure control assembly 300 can be mounted on a rail 35 that follows the lateral motion of the carrier head 12. For example, the rail 35 also extends along the radial dimension 164 of the platen 16. A controller 95, e.g., a computer, can synchronize the lateral translations of both the carrier head 12 and the body 310 so that they track each other. This ensures that the radially controllable zones of the body 310 remain aligned with their respective regions of the substrate 14 as the substrate moves laterally.

The distance between adjacent channels in the body 310 may range from a few millimeters (e.g., 1 mm, 2 mm) to hundreds of millimeters (e.g., 100 mm). Even though the fluid deflects the lower surface 182 of the polishing pad 18 at discrete locations (i.e. at locations vertical above the corresponding through hole 210 within which the fluid flows), due to the radial translation of the carrier head 12, the effect of the increase in interface pressure can be averaged over a determined width of a particular annular zone on the outer surface of substrate 14.

The pneumatic pressure control assembly 300 can include a bearing ring 350 that surrounds the body 310. In some implementations, the bearing ring 350 can be a fluid bearing ring. For example, the body and bearing ring 350 can be biased upwardly, but fluid injected between the body 310 and the platen 16 to maintain a vertical gap between of the body 310 and the bottom surface of the platen. Alternatively, rather than a fluid bearing ring, a contact bearing ring 350 can surround the body 310. The contact bearing ring 350 can be formed out of a low-wear material, e.g., a plastic.

Alternatively, the position of the body 310 can be fixed in the z direction. The fluid bearing ring 350 can be further coupled to an actuator 370 that translates along the z-direction such that a distance 365 along the z-direction between the top surface 301 and the bottom surface 162 of the platen 16 can be controlled (see FIG. 4E).

The top surface 301 of the body 310 does not contact surface 162 of the platen in order to reduce wearing out of the surfaces 301 and 162 from friction, and to allow the platen 16 to rotate above the body 310 for the substrate 14. The z-axis position of the body 310 can also be manipulated to control the amount of deflection of the polishing pad 18. For example, for an equal amount of fluid entering the channel 311 from the bottom surface 311 of the body 310, a larger distance 365 reduces the deflection imparted because some fluid may escape into the gap defined by the distance 365 resulting in a smaller amount of fluid that actually enters the through hole 210.

The entire assembly of the body 310 and the fluid bearing ring 350 can be supported by a bracket 360 that is mounted on a stationary point 395 on the rotating shaft 124 of the platen 16.

A metrology unit 398 is used to measure optical characteristics of the substrate 14. The metrology unit 398 can be positioned in and rotate with the platen 16. The metrology unit 398 can be located in a region of the platen 16 without through-holes 210.

In general, the platen 16 may contain more through-holes 210 than the number of corresponding channels in body 310. In some embodiments, some through-holes 210 will be "inactive"—no fluid is flowing through those through holes to deflect the surface 182 of the polishing pad 18.

Figure 4F:
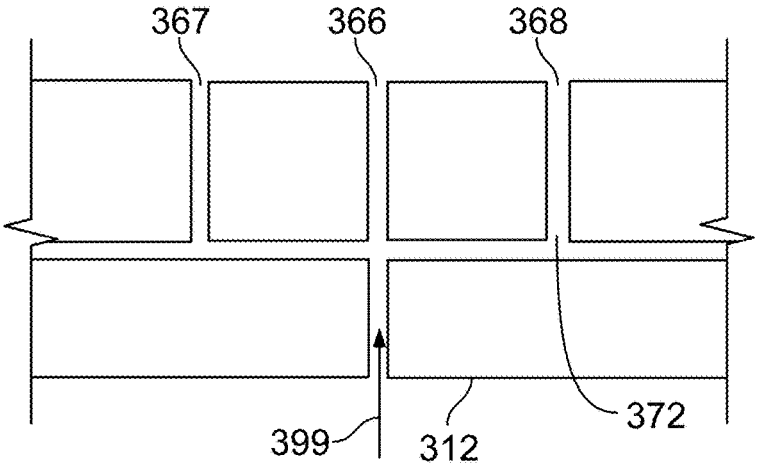

Each channel in the body 310 can have its own associated fluid outlet from the fluid delivery system 320. Alternatively, all the channels at the same radial distance from a center of the body 310 can share a single fluid outlet 312. For example, FIG. 4F shows a stretched out view along an arc 371 of the body 310. A channel 366 which receives fluid 399 from the fluid delivery system 330 extends through both the top and bottom surfaces of the body 310. A horizontal channel 372 connects various channels 367 formed at the same radial distance. Channels 367 have ends 368 that open at the top surface 311 of the body 310 but do not have openings at the bottom surface 312 of the body 310. The horizontal channel 372 directs fluid received from fluid outlet 312 to the open ends of channels 367 and out into a corresponding through hole 210 in the platen 16.

The through holes 210 defined in the platen 16 may have a cross-sectional dimension of 1 to 20 mm. The cross-sections may have circular, oval, polygonal or any other irregular shapes.

Instead of an integral body 310, the pneumatic pressure control system 300 can have discrete concentric rings 316, 317 and 318 each having a different radius, as shown in FIG. 4G. Each ring has a number of channels defined therein and the channels may extend through both the top and bottom surfaces of each respective ring, or they may be configured in a fashion similar to the arrangement depicted in FIG. 4F where each ring has a single inlet on the bottom surface of the ring and multiple outlets on the top surface of the ring closer to the surface 162 of the platen. Instead of a complete ring 315, the pneumatic pressure control system 300 can include partial segments 325-329 of a ring, the partial segments being arcs of circles having different radii. As described earlier, due to the rotation of platen the 16, the force imparted by fluid traveling through channels in segments 325-329 and along their corresponding through holes 210 in the platen 16 will result in a substantially rotationally symmetric post removal profile of the polished substrate 14.

In some implementations, each control element, e.g., each channel through the platen, can have its own bearing. For example, as shown in FIGS. 4H and 4I, each channel 321, 322, etc., can be surrounded by a bearing 440. Alternately, each a group of channels with a commonly controlled pressure from the same fluid outlet 331 can have its own bearing. The bearing can project upwardly toward the platen 16 from the top surface 311 of the body 310. Each bearing 440 can laterally surround a respective channel. The bearing 440 can be a contact bearing, in which case the bearing contacts the bottom surface of the platen 16, or a fluid bearing, in which case a small gap remains between the bearing and the platen.

Figure 5A:
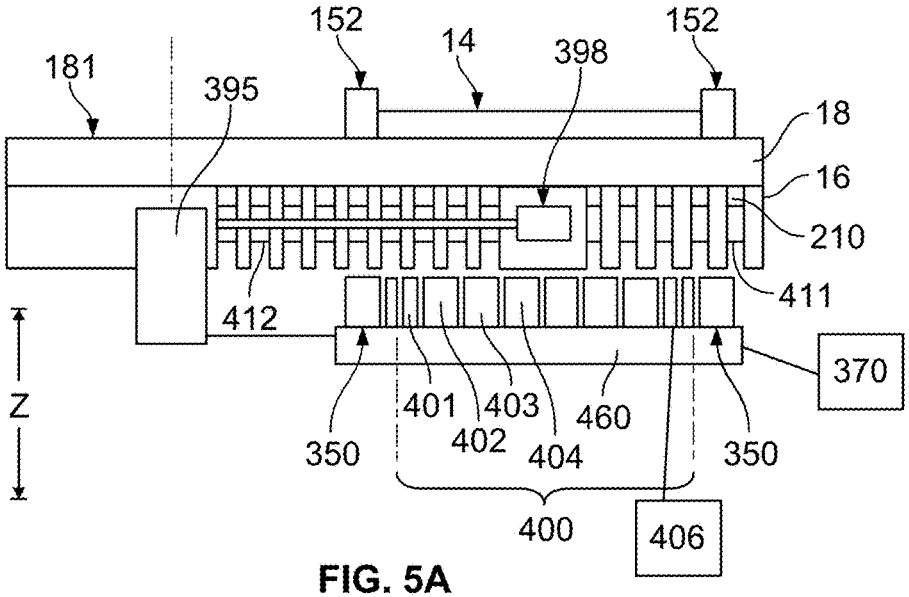
FIGS. 5A-5B show embodiments using a magnetic pressure control system.
Figure 5B:
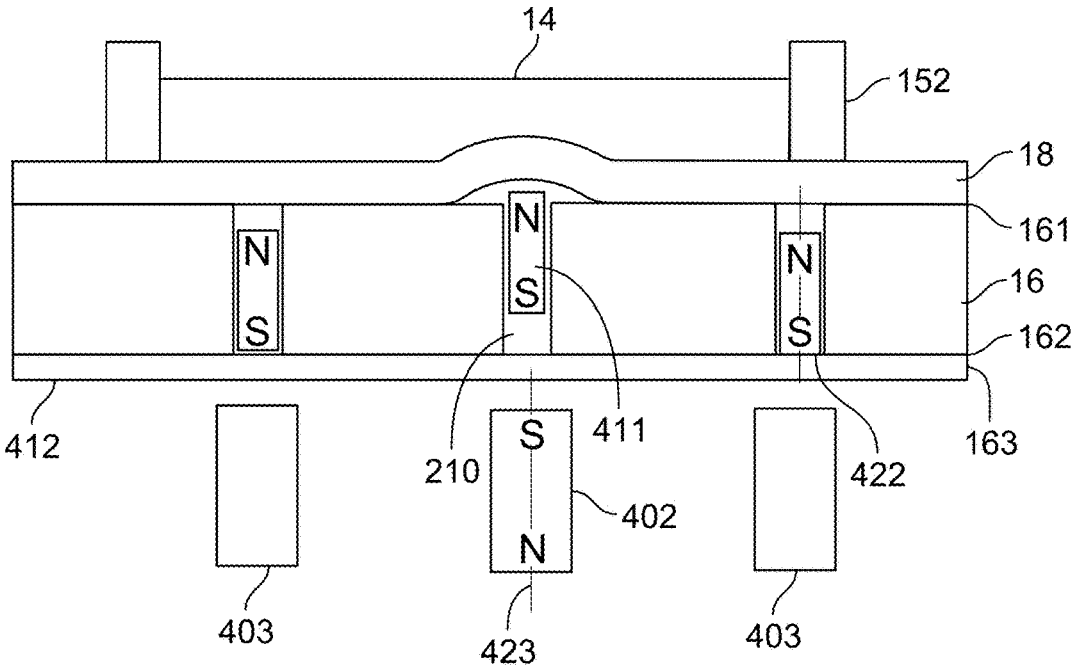

FIGS. 5A and 5B show a magnetic control system 500. A series of concentric annular electromagnets 401-403 having different radii is arranged below the platen 16. Each electromagnet is connected to electronic circuitry 406 that allows each electromagnet to be controlled individually to create magnetic fields of varying different magnitude as a function of time. The through holes in 210 in the platen 16 each contain a magnet (e.g., 411, 412). A polar axis is the vertical line passing through the magnet that connects the north and south poles of the magnet. The magnet 411 is arranged with its polar axis 422 parallel to the through hole 210. The electromagnets are also configured so that when an electrical current passes through the electromagnet, its polar axis 423 is parallel to polar axis 422. Instead of an electromagnet, a permanent magnet may also be used.

The magnet 411 is arranged so that when the electromagnet 401 is activated, the poles of the electromagnet 401 and the magnet 411 that are facing each other (i.e., the closest poles between the electromagnet 401 and the magnet 411) have the same polarity. As a result, the electromagnet 401 and magnet 411 repel each other. Due to the annular electromagnet 401 being fixed in place by the support 460, when a sufficiently large magnetic field is generated by the electromagnet 401, the magnet 411 is propelled upwards through the opening of the through hole 210 at the surface 160 of the platen 16. The magnet 411 then pushes on the bottom surface 182 of the polishing pad, deflecting it and increasing the interface pressure between the substrate and the polishing pad at a corresponding region vertically above the magnet 411. In FIG. 5B, electromagnet 402 is not activated while electromagnet 401 is activated. The electromagnet 401 propels the corresponding magnet 411 above the surface 161.

Magnetic force decreases quadratically with distance. If the magnetic field created by the electromagnet is strong enough, then the series of concentric annular electromagnets can be attached to a rail 435 which serves a similar function as the rail 35 in the pneumatic pressure control system 300. Fixing the electromagnets on a rail this way increases a distance 564 between the surface 162 of the platen and the top surface of the electromagnet. When the magnetic field generated by the electromagnets is not strong enough, the concentric series of electromagnets can be mounted by a bracket and fixed to the stationary point in the driving shaft 124 of the platen 16, in a similar fashion as that described above for the pneumatic pressure control system 300. When the series of electromagnets are mounted to the bracket, a fluid bearing ring 450 which serves the same function (i.e., z-axis control) surrounds the concentric electromagnets.

In some embodiments, the through holes 210 are perpendicular to and extend through the first and second surfaces 161 and 162 of the platen 16, as is the case for the platen 16 used with the pneumatic pressure control system 300. In such embodiments, to prevent the magnet 411 contained within each through holes 210 from falling out under the influence of gravity, a retaining sheet 163, e.g., of plastic, can be attached to the lower surface 162 so that the through holes 210 is not open to the surface 162 but is terminated by the retaining sheet 163. In this case, the magnet 411 does not fall out from the through hole 210 even when the electromagnet 410 is inactive (i.e., no current passes through the electromagnet 410).

The pattern 200 formed by the through holes 210 can be a regular (e.g., Cartesian or polar) grid or it may be a non-regular pattern. The through holes in the magnetic pressure control system are typically cylindrical in shape to accommodate the magnet 411.

The polishing pad can include a softer backing layer 110 that defines the lower surface 182 of the polishing pad 18 (i.e., a relatively compressible layer, such as a Suba-IV layer (from Rodel, Phoenix Ariz.). As described in FIGS. 2C and 2D, when the magnet 411 protrudes from the surface 161 the pressure is effectively transferred to a region on the polishing surface 181 directly in the vicinity above the magnet, allowing an increase in interface pressure on the outer surface 142 of the substrate 14 which is being polished.

A number of embodiments of the invention have been described. Nevertheless, it will be understood that various modifications may be made without departing from the spirit and scope of the invention. Accordingly, other implementations are within the scope of the following claims.

What is claimed is:

1. A polishing apparatus, comprising:

a platen having a first surface to support a polishing pad, a second surface on a side of the platen opposite the first surface, and a plurality of holes extending through the platen from the first surface to the second surface, the plurality of holes arranged in a regular first pattern;

a carrier head to hold a substrate against the polishing pad; and a pad pressure control assembly adjacent a side of the platen opposite the carrier head, wherein the pressure control assembly comprises a body having a third surface substantially parallel to the second surface of the platen and a plurality of conduits formed therein, wherein each conduit is configured to have an output end of the conduit on the third surface to provide a plurality of output ends, wherein the pad pressure control assembly is configured to direct fluid from the conduits to apply pressure through at least some of the plurality of holes to an underside of the polishing pad, wherein the plurality of conduits of the pressure control assembly are grouped into a plurality of independently controllable annular zones arranged in a second pattern that is different from the first pattern, wherein fluid flow through the conduits in each annular zone of the plurality of independently controllably annular zones is commonly controlled, and wherein the second surface of the platen is separated from the third surface of the body of the pad pressure control assembly by a gap that spans across the plurality output ends of the plurality of conduits in the body.

2. The polishing apparatus of claim 1, further comprising a bearing ring surrounding body of the plurality of pad pressure control assembly to seal an interface between the body and the platen.

3. The polishing apparatus of claim 2, wherein the bearing ring comprises a contact bearing ring to contact a bottom surface of the platen.

4. The polishing apparatus of claim 1, further comprising a linear rail which supports the body and along which the body can move in a first direction in a plane parallel to the first surface of the platen, the plane being the first distance away from the platen.

5. The polishing apparatus of claim 1, wherein the annular zones are concentric around a center of the body.

6. The polishing apparatus of claim 5, wherein the platen is rotatable about an axis, and the center of the body is offset from the axis.

7. The polishing apparatus of claim 1, wherein a distance between the body and the second surface of the platen is adjustable.

8. The polishing apparatus of claim 1, wherein the first pattern is a rectangular pattern.

9. The polishing apparatus of claim 1, wherein the first pattern is a non-polar pattern.

* * * * *